US005570512A

United States Patent [19]

Höppner

[11] Patent Number: 5,570,512

[45] Date of Patent: Nov. 5, 1996

[54] GRIP ARRANGEMENT FOR A CHAIN SAW

[75] Inventor: Klaus Höppner, Marbach, Germany

[73] Assignee: Andreas Stihl, Waiblingen, Germany

[21] Appl. No.: 494,188

[22] Filed: Jun. 23, 1995

[30] Foreign Application Priority Data

Jun. 23, 1994 [DE] Germany ..... 44 21 994.6

[51] Int. Cl.[6] ..... B27B 17/00; B26G 1/10

[52] U.S. Cl. ..... 30/383; 30/381

[58] Field of Search ..... 30/381–387

[56] References Cited

U.S. PATENT DOCUMENTS

| | | | |
|---|---|---|---|
| 4,010,544 | 3/1977 | Siman | 30/381 |
| 4,856,195 | 8/1989 | Grossmann et al. | 30/383 |
| 4,979,306 | 12/1990 | Koga et al. | 30/383 |
| 5,016,355 | 5/1991 | Gassen et al. | 30/383 |

FOREIGN PATENT DOCUMENTS 2470968 10/1981 France .

*Primary Examiner*—Douglas D. Watts
*Attorney, Agent, or Firm*—Robert W. Becker & Associates

[57] ABSTRACT

A grip arrangement for a motor chain saw, wherein the motor chain saw has a housing and motor arranged in the housing, a saw chain driven by the motor, a chain guide extending in the longitudinal direction of the motor chain saw for guiding the chain saw, includes a handle extending in the longitudinal direction of the motor chain saw. The handle has a first handle end connected to the top of the housing at a forward portion of the housing facing the chain guide and has a second handle end connected at the top of the housing to a rearward portion of the housing remote from the chain guide. The grip arrangement also includes a first lateral grip with a first grip end, a second grip end, and a center portion connected between the first and second grip ends. The first grip end is connected to a handle portion of the handle adjacent to the chain guide and the second grip end is connected laterally to rearward portion of the housing remote from the chain guide in the vicinity of the bottom of the housing. The center portion is positioned at a distance from the lateral side of the housing.

20 Claims, 7 Drawing Sheets

GRIP ARRANGEMENT FOR A CHAIN SAW

BACKGROUND OF THE INVENTION

The present invention relates to a grip arrangement for a motor chain saw with a motor arranged in a housing for driving the saw chain which is guided on a chain guide extending in the longitudinal direction of the motor chain saw. An upper handle extending in a longitudinal direction of the motor chain saw is connected with a first end in the area of the forward housing section facing the chain guide to the upper side of the housing and with a second end to the housing in the area of the rearward housing portion facing away from the chain guide. A lateral grip is provided the first end of which is connected to the upper handle in the area of a handle portion adjacent to the chain guide and the second end of which is laterally connected to the housing in the area of its underside. A center portion positioned between the first and second ends of the lateral grip is positioned at a distance approximately parallel to the lateral side of the housing.

Such a grip arrangement for a motor chain saw is known from French application 2479069. The upper handle that extends in the longitudinal direction of the motor chain saw is held by the operator for securing and guiding the motor chain saw with one hand. On one of the lateral sides of the housing a lateral grip is provided one end of which is connected to the forward portion of the upper handle and the other end of which is connected in the vicinity of the underside of the motor chain saw in the area of the forward housing section facing the chain guide. When the motor chain saw is not in operation, the ends of the lateral grip, in a top view, are positioned one atop the other whereby a center portion, located between the two ends, is positioned at a distance to a lateral side of the housing in order to be gripped by the operator with his second hand. Due to the substantially perpendicularly arranged planes of the handle and the grip, the motor chain saw can be guided by the operator such that the saw blade is guided downwardly and forwardly. For working positions deviating from this preferred position, ergonomically unfavorable hand positions can result which lead to cramping and tensioning of the muscles so that the operator experiences premature fatigue.

With a forwardly pointing saw blade the weight of the motor chain saw is carried by the hand which grips the upper handle. The lateral grip which is gripped by the second hand serves substantially only for guiding the motor chain saw. Due to the resulting different weight loading of the arms, muscle tensioning and cramps may occur which result lead to frequent work interruptions.

It is therefore an object of the present invention to provide a grip arrangement for a motor chain saw with which the motor chain saw can be guided in any desired working position over an extended period of time without causing fatigue.

SUMMARY OF THE INVENTION

The grip arrangement for a motor chain saw, comprising a housing and a motor arranged in the housing, a saw chain driven by the motor, a chain guide extending in a longitudinal direction of the motor chain saw for guiding the saw chain, primarily comprises:

a handle extending in the longitudinal direction of the motor chain saw, the handle having a first handle end connected at a top of the housing to a forward portion of the housing facing the chain guide and having a second handle end connected at the top of the housing to a rearward portion of the housing remote from the chain guide; and a first lateral grip comprising a first grip end, a second grip end, and a center portion connected between the first and the second grip ends, wherein the first grip end is connected to a handle portion of the handle adjacent to the chain guide and the second grip end is connected laterally to a rearward portion of the housing remote from the chain guide, in the vicinity of a bottom of the housing, and wherein the center portion is positioned at a distance from a lateral side of the housing.

Preferably, the center portion is curved. In a preferred embodiment of the present invention the center portion has a curvature of a circular arc section, when projected on to a plane defined by the chain guide, and a center point of the circular arc section is located at a side of the center portion facing the handle.

Advantageously, the center portion is comprised of a first and a second section and a curved section connecting the first and second sections. The curved section has a curvature of a quarter circular arc, wherein the first section is adjacent to the handle and extends perpendicularly to the longitudinal direction of the motor chain saw and substantially parallel to the lateral side of the housing and wherein the second section extends substantially parallel to the longitudinal direction.

Expediently, the first lateral grip has a grip portion adjacent to the first grip end that is substantially perpendicular to a plane defined by the chain guide and has a length (a).

Preferably, the second handle end is spaced at a shorter distance from the forward portion of the housing then the second grip end.

Advantageously, the housing has a support section in the vicinity of the rearward portion, the support section projecting upwardly past the top, wherein the second handle end is connected to the support section.

Preferably, the support section has an end face facing the chain guide and the second handle end is connected to the end face.

Expediently, the first lateral grip, in the vicinity of the second grip end, has an engagement opening penetrating the first lateral grip. The engagement opening has a center axis pointing toward the lateral side. Preferably, the center axis points toward the first grip end.

In a preferred embodiment of the present invention the engagement opening opens into conical portions at both ends thereof.

Preferably, the engagement opening is positioned at a transition between the center portion and a lower portion of the first lateral grip at which the second grip end is provided.

Expediently, the grip arrangement further comprises a second lateral grip connected to the other lateral side of the housing such that the first and second lateral grips are arranged mirror-symmetrical to one another relative to a longitudinal center plane of the handle.

By providing that the second grip end of the lateral grip facing away from the handle is connected in the area of the rearward portion facing away from the chain guide, the lateral grip becomes longer so that a greater area is provided which can be gripped by the hand of the operator. Depending on the orientation of the motor chain saw, the operator can grip the lateral grip at the upper, central, or lower portion whereby respectively an ergonomically advantageous hand position can be selected by the operator.

In a preferred embodiment of the invention the lateral grip, in a projection onto the plane of the chain guide, is curved and preferably describes approximately a circular arc section which is oriented such that the center point of the circular arc section is positioned above the side of the lateral grip facing the upper handle. This ensures that, as desired by the operator, an individual gripping and holding with differently oriented hand positions is possible.

In a further embodiment of the invention the lateral grip in the area of its first grip end is provided with an upper portion which extends substantially perpendicular to the plane of the chain guide and has an extension (length) that corresponds substantially to the width of the hand of the operator so that a gripping and carrying with one hand is possible in the area of this upper portion. The weight of the motor chain saw in this grip position is thus uniformly distributed onto both arms of the operator.

Preferably, in the area of the second grip end of the lateral grip an engagement opening is provided within the lateral grip which has a longitudinal center axis that is pointing toward the lateral side of the housing. Into this engagement opening a supporting element, for example, a carabiner hook, can be inserted in order to connect the motor chain saw to a support strap worn by the operator for transporting the chain saw. The positioning of the engagement opening ensures a transporting position in which the saw blade is substantially oriented verticly downwardly toward the ground.

BRIEF DESCRIPTION OF THE DRAWINGS

The object and advantages of the present invention will appear more clearly from the following specifications in conjunction with the accompanying drawings, in which.

DESCRIPTION OF PREFERRED EMBODIMENT

The present invention will now be described in detail with the aid of several specific embodiments utilizing FIGS. 1 through 8.

Figure 1:
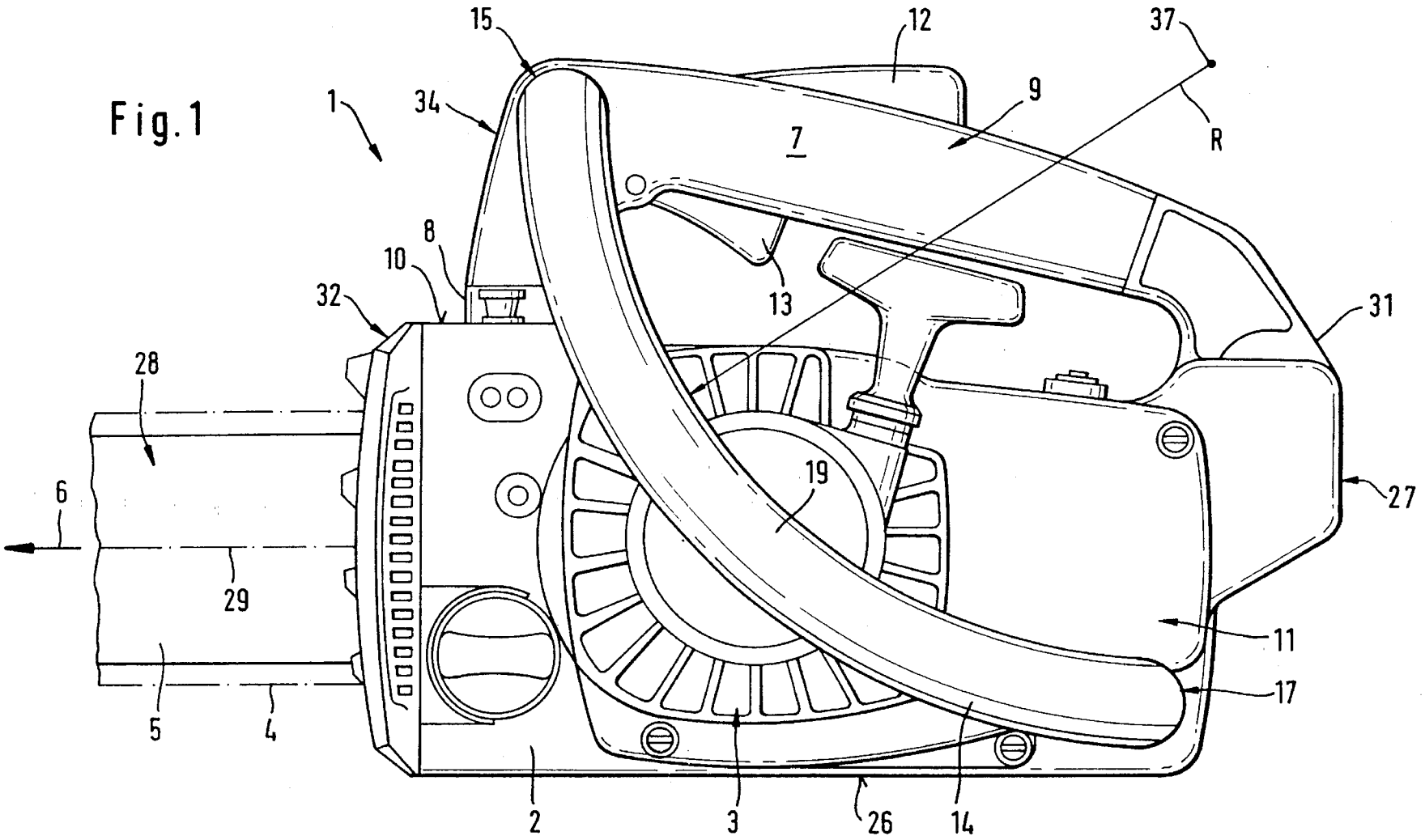
FIG. 1 shows a side view of a motor chain saw with the inventive grip arrangement.

The motor chain saw 1 represented in FIG. 1 comprises a motor 3 arranged within a housing 2, for example, a two-stroke combustion engine which drives a saw chain 4 guided on a chain guide 5. The housing 2 comprises a bottom 26 which serves as a support surface when resting the motor chain saw 1 on a surface whereby in this position of the motor chain saw the plane 28 of the chain guide 5 is perpendicular to the ground. A handle 7 extending in the longitudinal direction 6 of the chain guide 5 is arranged at the top 10 of the housing opposite the bottom 26. Preferably, the handle 7 is arranged above the center of gravity of the motor chain saw 1. In the handle housing 9 of the handle 7 a throttle lever 13 and a throttle lever lock 12 are provided. The handle 7 is connected with its first handle end 8 in the area of the forward housing portion 32 facing the chain guide 5 to the top 10 of the housing 2 and with its second handle end 31 is connected to a rearward housing portion 27 remote from the chain guide 5.

For guiding and holding the motor chain saw with both hands, a lateral grip 14 is provided at one of the lateral sides 11 of the housing 2 whereby the first grip end 15 is connected to the forward handle portion 34 of the handle 7 positioned adjacent to the chain guide 5. It may be expedient to connect the first grip end 15 to the lateral side 11 of the housing 2 so that the upper handle 7 and the lateral grip 14 are connected separately to the housing 2. The lateral grip 14 extends along the lateral side 11 over the entire constructive height of the housing 2 and is connected with its second grip end 17 in the area of the bottom 26 of the housing 2 to the lateral side 11 of the housing. Between the grip ends 15 and 17 a center portion 19 extends which is positioned at a distance approximately parallel to the lateral side 11 of the housing 2. Inventively, the second grip end 17 of the lateral grip 14 is connected in the area of the rearward housing portion 27 facing away from the chain guide 5 so the lateral grip 14 extends over the entire height as well as over the most of the length of the housing 2. It may be expedient to position the lateral grip 14 parallel to the lateral side 11 of the housing 2 over the entire length of the housing. Between the first upper grip end 15 and the second lower grip end 17 the central section 19 of the lateral grip 14, when viewed in a projection onto the plane 28 of the chain guide 5, is curved and describes approximately a circular arc section preferably a quarter circular arc having a radius R. The center point 37 of the circular arc section is positioned expediently above the lateral grip 14, i.e., on the longitudinal side of the center portion 19 facing the handle 7.

Figure 2:
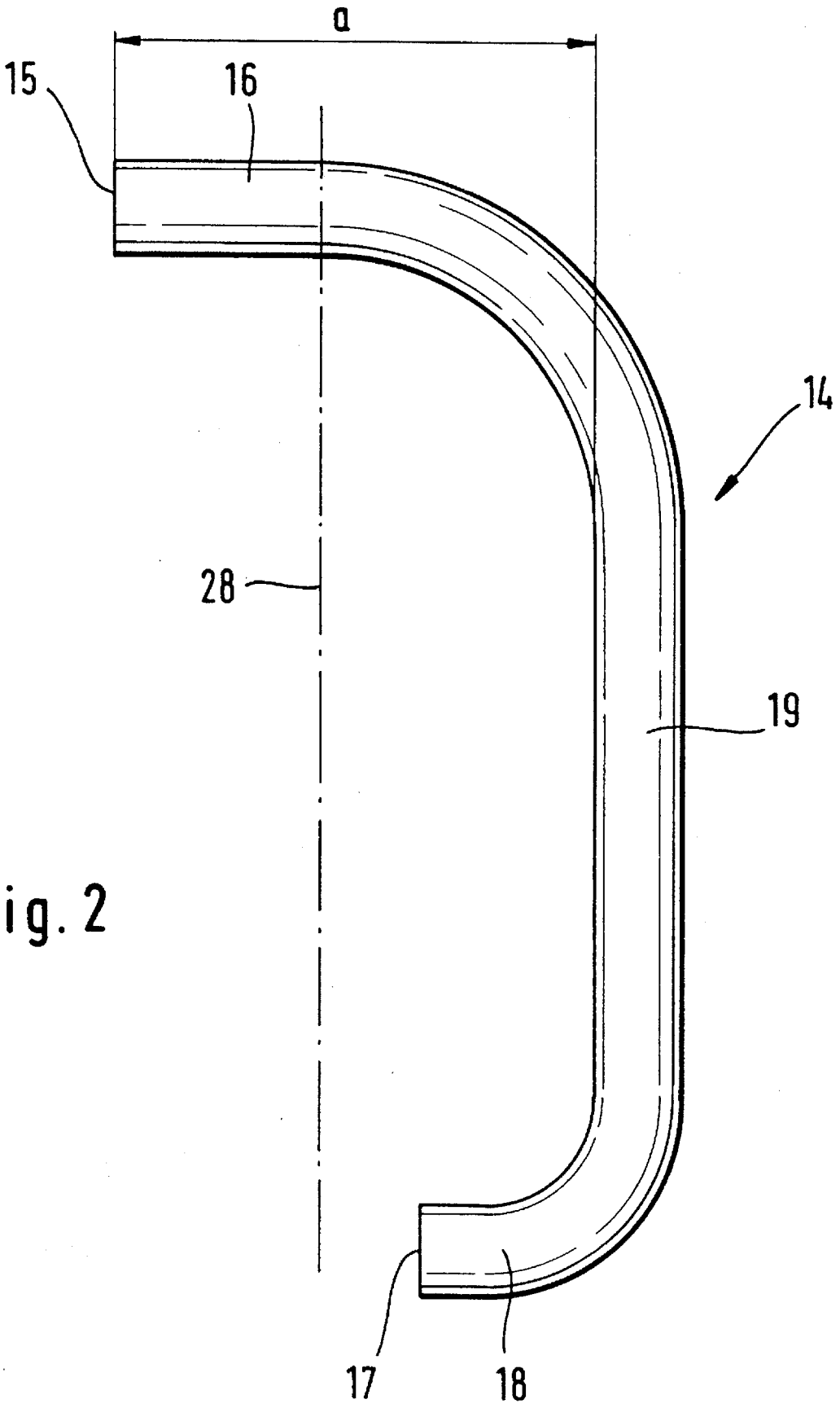
FIG. 2 shows a side view of a lateral grip of the inventive grip arrangement.

As can be seen in FIG. 2, the lateral grip 14 in the area of its upper grip end 15 has an upper section 16 which partially projects past the top 10 of the housing 2. The upper section 16, positioned substantially perpendicular to the plane 28 of the chain guide 5, is connected to the forward portion 34 of the handle 7 and has an extension or length (a) which corresponds approximately to the hand width of the operator in order to allow for a gripping of the lateral grip 14 at this upper section. It is thus ensured that an operator, when, for example, the chain guide 5 is forwardly oriented, can grip the motor chain saw with both hands in the area of the grip, respectively, handle adjacent to the top of the housing for holding and guiding. It is furthermore ensured that the center portion 19 of the lateral grip 14 is provided with a sufficient lateral distance to the lateral side 11 of the housing 2 so that for the fingers of the hand gripping the grip a sufficient space for movement is allowed.

Like the upper portion 16 of the lateral grip 14 the lower portion 18 is also expediently perpendicular to the plane 28 of the chain guide 5 so that the center axis of the upper portion 19 and the lower portion 18 extend approximately parallel to one another. According to FIG. 2, the lower portion 18 in the shown embodiment is shorter than the upper portion 16. The lower portion 18 is directly secured to the lateral side 11 of the housing 2 while the upper portion 16 at least partially projects past the top 10 of the housing 2. It may be expedient that the lower portion 18 also projects partially past the bottom 26 of the housing 2 and is connected to the bottom 26 of the motor chain saw.

It can also be seen in FIG. 2 that the transition between the upper portion 16 and the center portion 19, respectively, the center portion 19 and the lower portion 18 is respectively embodied as a quarter circular arc, when projected onto a vertical plane. The radii of the two quarter circular arc sections can be different.

Figure 3:
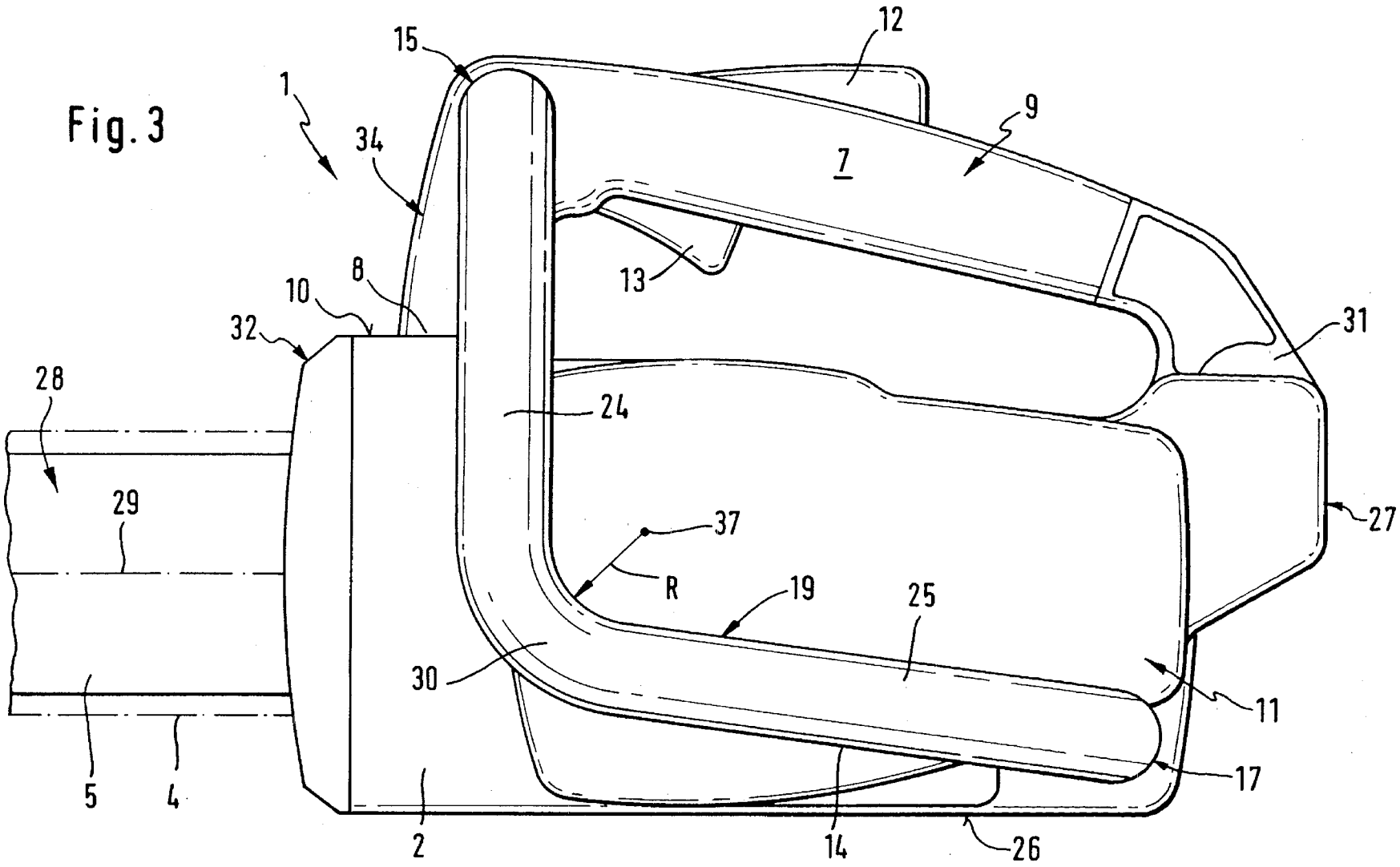
FIG. 3 shows a side view of the motor chain saw with the inventive grip arrangement in another embodiment.

In the embodiment according to FIG. 3 the center portion 19 of the lateral grip 14 is comprised of two sections 24 and 25, positioned at an angle relative to one another, which are connected by a circular arc section 30 which is preferably embodied as a quarter circular arc. The section 24 adjacent to the handle 7 extends expediently substantially perpendicular to the longitudinal center axis 29 approximately parallel to the lateral side 11. The section 25 connected to the section 24 by the part circular ark 30 extends however parallel to the direction of the longitudinal center axis 29. As in the embodiment in FIG. 1 the center point 37 of the circular arc section 30 is above the center portion 19 of the lateral grip 14.

Figure 4:
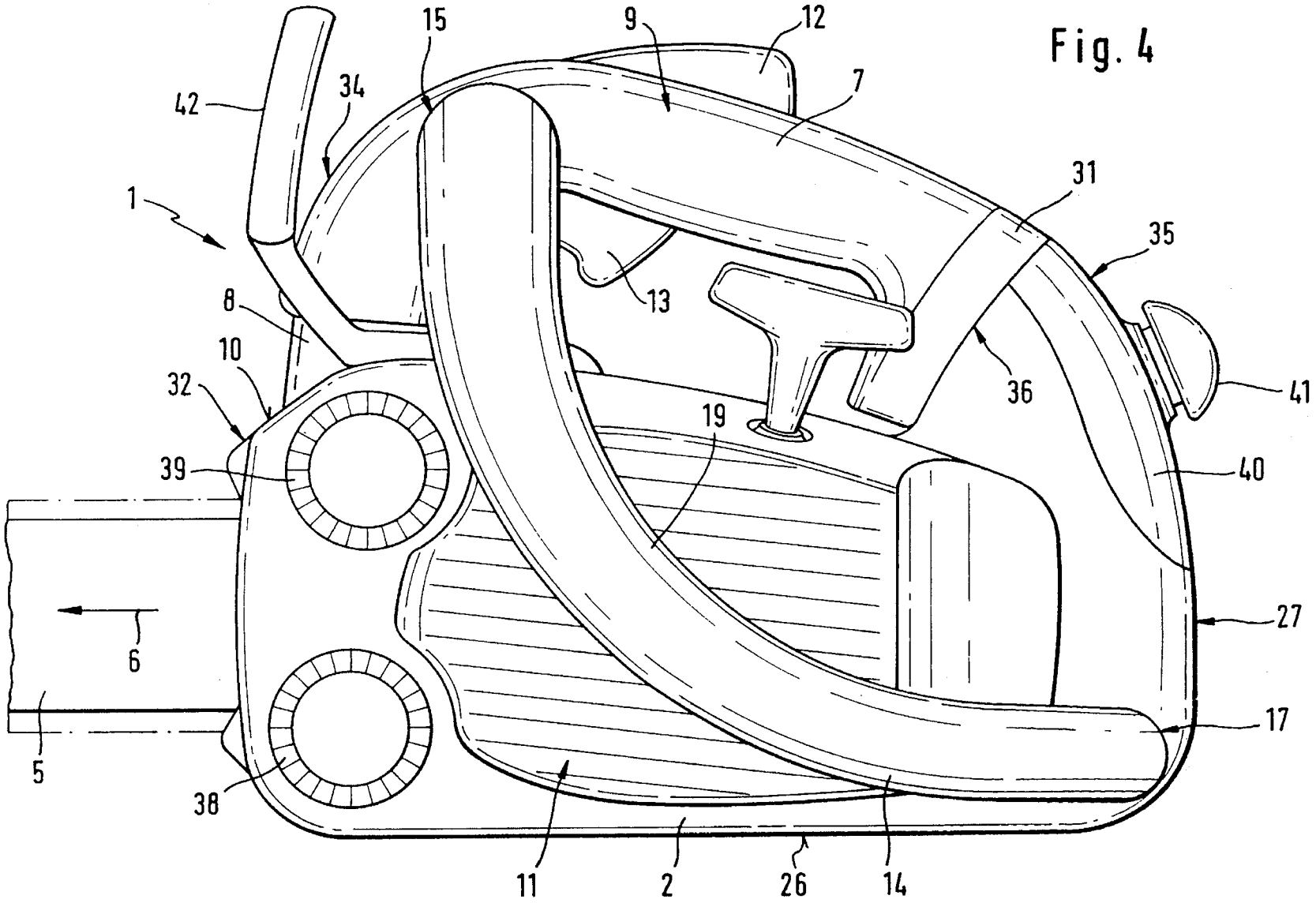
FIG. 4 shows a side view of a motor chain saw with an inventive grip arrangement in a further embodiment.

In a further embodiment of the grip arrangement according to FIG. 4, the second handle end 31 of the handle 7 facing away from the chain guide 5, when viewed in the longitudinal direction, is positioned at a shorter distance to the chain guide 5 than the second lower grip end 17 of the lateral grip 14. The housing 9 of the handle 7 is expediently arranged above the center of gravity of the motor chain saw 1 so that upon holding the motor chain saw by the handle 7 the tendency to perform tilting movements about the transverse axis of the motor chain saw is low. Due to the embodiment of the lateral grip 14 so as to have a longer extension in the longitudinal direction 6 than the handle 7, the chain guide 5 of the motor chain saw can be ergonomically favorably pivoted upwardly or downwardly.

The motor chain saw comprises closeable filling sockets 38 and 39 for oil and fuel which are arranged within the area of the forward housing portion 32 substantially staggered in the vertical direction (height of the housing). With this arrangement oil and fuel can be easily refilled when the motor chain saw is placed laterally onto the ground whereby the area of the filling sockets is not obstructed by the lateral grip 14.

The lateral grip 14 may have a tapering cross-section from the first upper grip end 15 to the second lower grip end 17. In the embodiment according to FIG. 4 the cross-section tapers in the area of the lateral side 11 of the housing along the length of the lateral grip 14 toward the rearward grip end 17 in a continuous and steady fashion. However, it is also possible to embody parts of the center portion 19, respectively, the substantially horizontally extending upper and lower portion 16, 18 so as to be cylindrical.

The rearward housing portion 27 of the housing 2 is formed as a support section 35 projecting past the top 10 of the housing 2. The support section 35 may expediently be closed by a filter box cover 40 which, upon releasing a closure button 41, allows access to the space within the support portion 35 in which the air filter is arranged.

The support portion 35 is provided with an end face 36 facing the upper handle 7 to which the second rearward grip end 31 of the handle 7 is connected thereto in a flange-type arrangement. Due to the upwardly extending support section 35, which partially projects past the top 10 of the forward housing section 32, the longitudinal extension of the handle 7 is shortened.

The lateral grip 14 may have an elliptical cross-section in order to be ergonomically gripped by the hand of the operator so that downtimes due to fatigue can be shortened.

In the area of the forward housing portion 32 a protective bracket 42 is provided which is positioned in front of the forward handle section 34. This protective bracket, upon back-lashing of the motor chain saw during operation, releases a safety brake and stops the motor chain saw.

Figure 5:
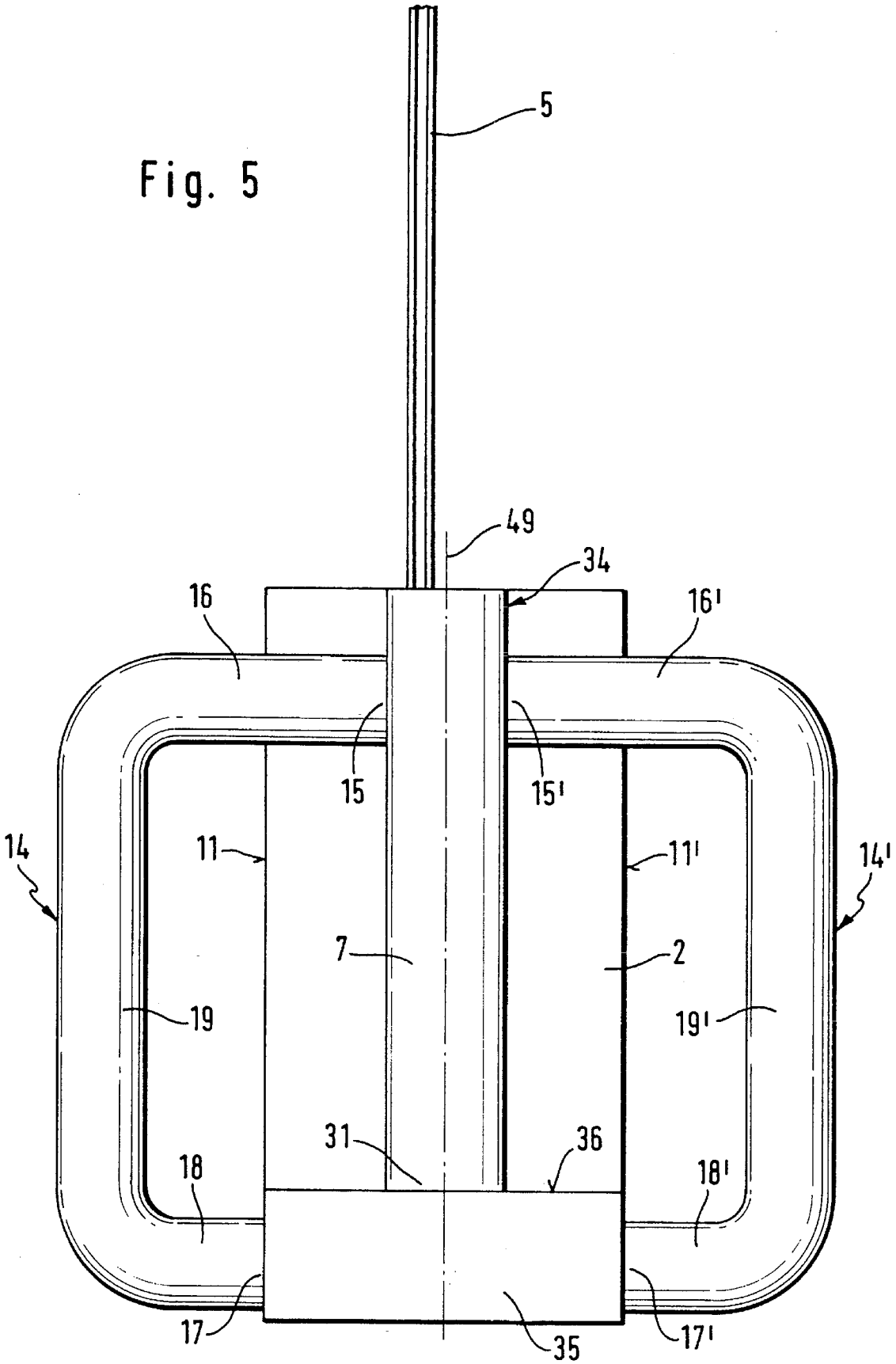
FIG. 5 is a schematic representation of a motor chain saw in a top view with a lateral grip arranged at one of the lateral sides.

As shown in FIG. 5, it may be expedient to arrange on both lateral sides 11, 11' of the motor chain saw 1 at the housing 2 a lateral grip 14, respectively, 14' whereby both lateral grips 14, 14' are advantageously positioned mirror-symmetrically to the longitudinal center plane 49 extending through the upper handle 7. The reference numerals of the second lateral grip 14' correspond to those of the lateral grip 14, in each case distinguished by the prime sign. The shown arrangement allows for excellent handling of the motor chain saw. Furthermore, such a motor chain saw can be used by left handed and right handed operators without problems in an optimal manner.

Figure 6:
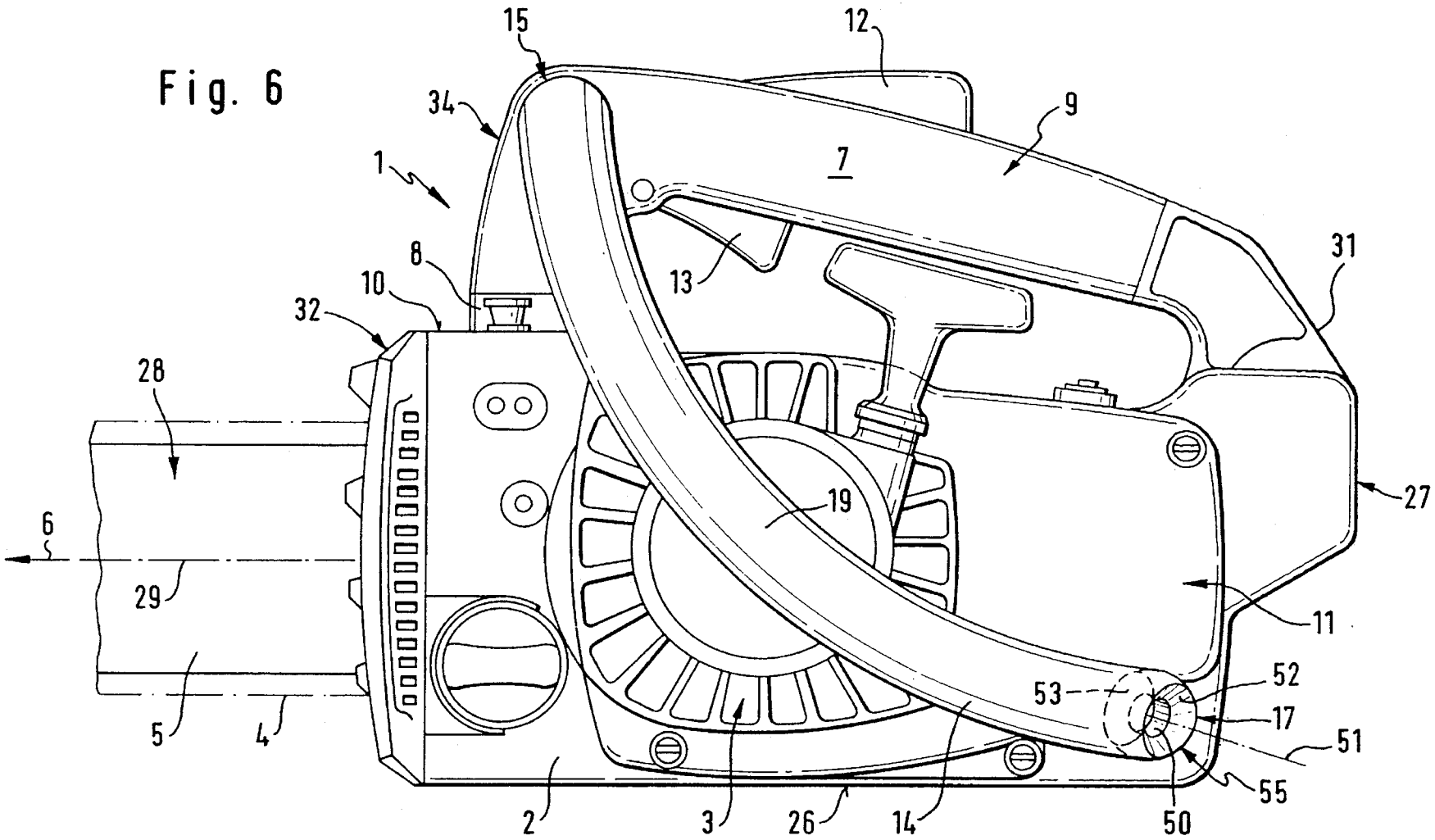
FIG. 6 is a side view of a motor chain saw according to FIG. 1 with an engagement opening provided within the lateral grip.

In the embodiment according to FIG. 6 an engagement opening 50 is provided at the lateral grip 14 which in the shown embodiment is in the form of a bore penetrating the lateral grip 14. The engagement opening 50 may have cross-sectional shapes that deviate from the shown circular shape but may be expedient as well.

Figure 7:
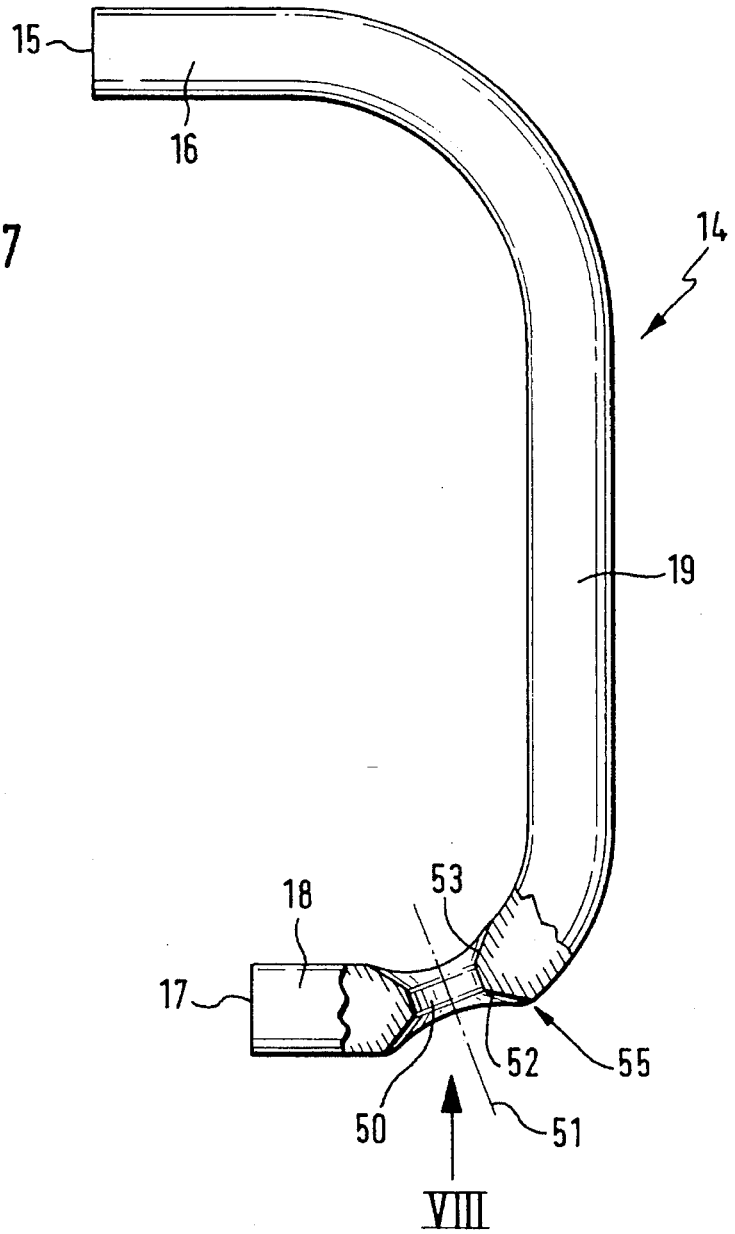
FIG. 7 shows a part sectional view of the lateral grip of FIG. 6.
Figure 8:
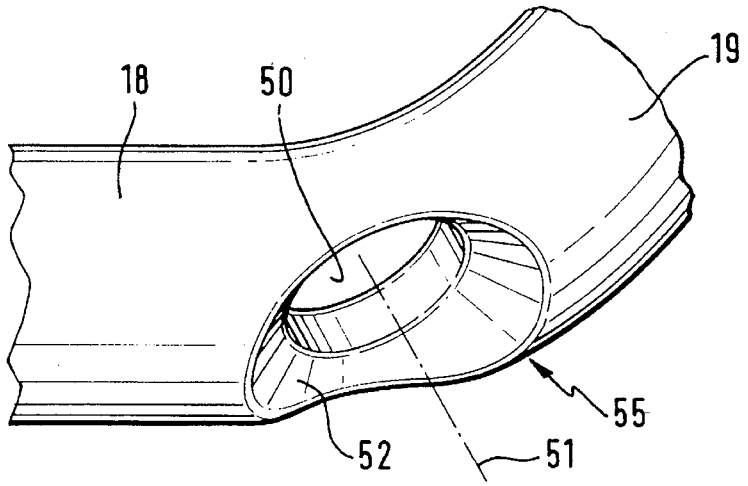
FIG. 8 shows a plan view of the engagement opening according to arrow VIII of FIG. 7.

The longitudinal center axis 51 of the engagement opening 50 points in the direction toward the lateral side 11 of the housing 2 of the motor chain saw 1. The engagement opening 50 opens at both axial ends into conical portions 52, 53 so that the thickness of the lateral grip 14 in the area of the engagement opening 50 is reduced such that the insertion of a support hook, carabiner hook etc., is facilitated. As shown in FIG. 7 the longitudinal center axis 51 of the engagement opening 50 points in the direction toward the first grip end 15 of the lateral grip 14, preferably in a plane which is defined by the end portion 16 and 18.

Preferably, the engagement opening 50 is located in the transmition 55 between the portion 18 neighboring the grip end 17 and the center portion 19 of the lateral grip 14. With this arrangement, the engagement opening 50 is positioned in the area of the rearward end of the motor chain saw 1 close to the bottom 26 spaced at a distance to the lateral side 11 of the housing 2. When a carabiner hook is inserted and the motor chain saw is subsequently held by the carabiner secured in the engagement opening 50, the chain guide 5 will be downwardly oriented toward the ground, due to the gravitational force, and is thus in a position in which the risk of an accident is reduced.

The present invention is, of course, in no way restricted to the specific disclosure of the specification and drawings, but also encompasses any modifications within the scope of the appended claims.

What I claim is:

1. A grip arrangement for a motor chainsaw, said motor chainsaw comprising a housing and a motor arranged in said housing, a saw chain driven by said motor, a chain guide extending in a longitudinal direction of said motor chainsaw for guiding said saw chain, wherein said grip arrangement comprises:

a handle extending in said longitudinal direction of said motor chainsaw, said handle having a first handle end connected at a top of said housing to a forward portion of said housing facing said chain guide and having a second handle end connected at said top of said housing to a rearward portion of said housing remote from said chain guide;

a first lateral grip comprising a first grip end, a second grip end, and a center portion connected between said first and said second grip ends, wherein said first grip end is connected to a handle portion of said handle adjacent to said chain guide and said second grip end is connected laterally to a rearward portion of said housing, remote from said chain guide, in the vicinity of a bottom of said housing and wherein said center portion is positioned at a distance from a lateral side of said housing;

wherein said center portion is curved and has a curvature of a circular arc section, when projected onto a plane defined by said chain guide; and wherein a center point of said circular arc section is located at a side of said center portion facing said handle.

2. A grip arrangement according to claim 1, wherein said first lateral grip has a grip portion adjacent to said first grip end that is substantially perpendicular to a plane defined by said chain guide and has a length.

3. A grip arrangement according to claim 1, wherein said second handle end is spaced at a shorter distance from said forward portion of said housing than said second grip end.

4. A grip arrangement according to claim 1, wherein said housing has a support section in the vicinity of said rearward portion, said support section projecting upwardly past said top, wherein said second handle end is connected to said support section.

5. A grip arrangement according to claim 4, wherein said support section has an end face facing said chain guide and wherein said second handle end is connected to said end face.

6. A grip arrangement according to claim 1, further comprising a second lateral grip connected to the other lateral side of said housing such that said first and second lateral grips are arranged mirror-symmetrical to one another relative to a longitudinal center plane of said handle.

7. A grip arrangement for a motor chainsaw, said motor chainsaw comprising a housing and a motor arranged in said housing, a saw chain driven by said motor, a chain guide extending in a longitudinal direction of said motor chainsaw for guiding said saw chain, wherein said grip arrangement comprises:

a handle extending in said longitudinal direction of said motor chainsaw, said handle having a first handle end connected at a top of said housing to a forward portion of said housing facing said chain guide and having a second handle end connected at said top of said housing to a rearward portion of said housing remote from said chain guide;

a first lateral grip comprising a first grip end, a second grip end, and a center portion connected between said first and said second grip ends, wherein said first grip end is connected to a handle portion of said handle adjacent to said chain guide and said second grip end is connected laterally to a rearward portion of said housing, remote from said chain guide, in the vicinity of a bottom of said housing and wherein said center portion is positioned at a distance from a lateral side of said housing; and wherein said center portion is comprised of a first and a second section and a curved section connecting said first and second sections, wherein said curved section has a curvature of a quarter circular arc, wherein said first section is positioned adjacent to said handle and extends perpendicularly to said longitudinal direction of said motor chainsaw and substantially parallel to said lateral side of said housing and wherein said second section extends substantially parallel to said longitudinal direction.

8. A grip arrangement according to claim 7, wherein said first lateral grip has a grip portion adjacent to said first grip end that is substantially perpendicular to a plane defined by said chain guide and has a length.

9. A grip arrangement according to claim 7, further comprising a second lateral grip connected to the other lateral side of said housing such that said first and second lateral grips are arranged mirror-symmetrical to one another relative to a longitudinal center plane of said handle.

10. A grip arrangement for a motor chainsaw, said motor chainsaw comprising a housing and a motor arranged in said housing, a saw chain driven by said motor, a chain guide extending in a longitudinal direction of said motor chainsaw for guiding said saw chain, wherein said grip arrangement comprises:

a handle extending in said longitudinal direction of said motor chainsaw, said handle having a first handle end connected at a top of said housing to a forward portion of said housing facing said chain guide and having a second handle end connected at said top of said housing to a rearward portion of said housing remote from said chain guide;

a first lateral grip comprising a first grip end, a second grip end, and a center portion connected between said first and said second grip ends, wherein said first grip end is connected to a handle portion of said handle adjacent to said chain guide and said second grip end is connected laterally to a rearward portion of said housing, remote from said chain guide, in the vicinity of a bottom of said housing and wherein said center portion is positioned at a distance from a lateral side of said housing; and wherein said first lateral grip, in the vicinity of said second grip end, has an engagement opening penetrating said first lateral grip, said engagement opening having a center axis pointing toward said lateral side.

11. A grip arrangement according to claim 10, wherein said center portion is curved.

12. A grip arrangement according to claim 11, wherein said center portion has a curvature of a circular arc section, when projected onto a plane defined by said chain guide, and wherein a center point of said circular arc section is located at a side of said center portion facing said handle.

13. A grip arrangement according to claim 10, wherein said center axis points toward said first grip end.

14. A grip arrangement according to claim 10, wherein said engagement opening opens into conical portions at both ends thereof.

15. A grip arrangement according to claim 10, wherein said engagement opening is positioned at a transition between said center portion and a lower portion of said first lateral grip at which said second grip end is provided.

16. A grip arrangement according to claim 10, wherein said first lateral grip has a grip portion adjacent to said first grip end that is substantially perpendicular to a plane defined by said chain guide and has a length.

17. A grip arrangement according to claim 10, further comprising a second lateral grip connected to the other lateral side of said housing such that said first and second lateral grips are arranged mirror-symmetrical to one another relative to a longitudinal center plane of said handle.

18. A grip arrangement according to claim 10, wherein said second handle end is spaced at a shorter distance from said forward portion of said housing than said second grip end.

19. A grip arrangement according to claim 10, wherein said housing has a support section in the vicinity of said rearward portion, said support section projecting upwardly past said top, wherein said second handle end is connected to said support section.

20. A grip arrangement according to claim 19, wherein said support section has an end face facing said chain guide and wherein said second handle end is connected to said end face.

* * * * *